United States Patent [19]

Anderson et al.

[11] Patent Number: 4,641,571

[45] Date of Patent: Feb. 10, 1987

[54] TURBO FAN VENT

[75] Inventors: William J. Anderson; Wayne R. Anderson; Larry D. Robinson, all of Taylorsville, Miss.

[73] Assignee: Enamel Products & Plating Co., McKeesport, Pa.

[21] Appl. No.: 754,907

[22] Filed: Jul. 15, 1985

[51] Int. Cl.[4] ..... F23L 17/10

[52] U.S. Cl. ..... 98/72; 98/75

[58] Field of Search ..... 98/69, 72, 75

[56] References Cited

U.S. PATENT DOCUMENTS

| | | | |
|---|---|---|---|
| 975,636 | 11/1910 | Powers | 98/69 |
| 1,738,526 | 12/1929 | Diebel | 98/72 |
| 1,993,622 | 3/1935 | Peters et al. | 98/72 |
| 2,227,852 | 1/1941 | Smith | 98/72 |
| 2,856,838 | 10/1958 | Mack | 98/55 |
| 3,392,659 | 7/1968 | Rovsey | 98/72 |
| 3,430,550 | 3/1969 | Smith et al. | 98/72 |
| 3,739,708 | 6/1973 | Felter | 98/72 |
| 4,086,028 | 4/1978 | Felter | 416/277 A |

FOREIGN PATENT DOCUMENTS

| | | | |
|---|---|---|---|
| 104140 | 2/1917 | United Kingdom | 98/72 |

*Primary Examiner*—Harold Joyce

*Attorney, Agent, or Firm*—Lee, Smith & Zickert

[57] ABSTRACT

A turbo fan vent for use on the roof of a building and having a close-louvered low profile turbine affixed to a rotary shaft which is rotationally supported by bracing and bearing means associated with a lower concentric collar. The collar is spaced inwardly of said turbine and is vertically overlapped by the turbine. The rotary shaft carries a large fan blade assembly arranged within said collar. The collar has a diameter substantially less than the side wall of the turbine whereby to create a large passageway for effective air ventilation. The turbine is freely rotatable by wind currents to rotate the exhaust fan assembly to draw air upwardly through said collar and outwardly through the passageway. The collar is adapted to be mounted onto a complementarily shaped stack adaptor affixed to the roof of a structure and communicative interiorly thereof.

12 Claims, 4 Drawing Figures

TURBO FAN VENT

BACKGROUND AND SUMMARY OF INVENTION

The invention relates to wind powered ventilators adapted to be mounted on the roof of a building.

Rotary-type turbine ventilators have long been used. Generally, the known devices either take the shape of a large sphere having open vanes which are angled whereby to be moved in a rotational manner by wind velocity.

Certain other styles of roof ventilators utilize windmill-type fan blade assemblies which are similarly rotated by wind currents.

A few of the known prior art ventilators have included secondary ventilating means in the form of a fan assembly mounted along the rotating shaft of the turbine, sometimes in association with a mounting collar which supports the device on the roof. The roof mounting structure remains static while the turbine rotates closely therearound.

Particular problems with known rotary turbine ventilators involve the open vane structures in that water may intrude into the building structure below.

Additionally, conventional turbine-type roof ventilators provide very unsightly large spherical turbines, or hats, which makes their use in residential construction less appealing.

The prior art devices also provide for the close rotating association of the turbine with respect to the stationary collar. Thus, noise caused by vibration between the spinning turbine and collar have made this construction less desirable.

By using closely spaced turbine blades, certain prior art constructions require that the turbine must spin in order to ventilate the structure. If wind speeds are very slight, or if the shaft bearings freeze up, these kinds of devices fail to effectively provide sufficient air space for the heated air in an attic, or other structure below, to be evacuated. This is compounded inasmuch as should the weather become inclement, the immobile turbine allows rain, sleet or snow to enter the structure, which can result in water damage to the building.

Accordingly, the present invention provides a significant improvement and an advance in the art of wind powered ventilators by providing a low profile turbine in the form of a relatively flat hood or dome.

In furtherance of the solutions to the problems found in the prior art, the present invention provides a turbine having closed louvers, or fins, to be driven by the wind so that rain, sleet or snow is prevented from entering into the structure below.

The invention utilizes a large fan blade assembly affixed to the rotating shaft within the mounting collar. The fan blade assembly may be provided with a large diameter which is only slightly less than the mounting collar to achieve a very forceful evacuation of air for the efficient ventilation of the structure below.

The present invention includes a low profile turbine and yet provides an enlarged ventilating space between the turbine and the mounting collar whereby even during diminished wind conditions, heated air may still be ventilated from the structure below.

An additional benefit is found wherein the large spacing between the turbine and mounting collar prevents the rotating turbine from noisily contacting the edge of the mounting collar as it is being rotated by the wind.

The invention further allows for the quick removal of the turbine from an associating rotating shaft whereby bearings arranged with the shaft may be easily lubricated when needed.

The weather-resistant features of the invention are also enhanced by the capability of the close-louvered turbine to vertically overlap the upper rim of the mounting collar in order to impede the intrusion of rain during windy conditions in which the rain might be forcibly thrust in all directions.

SUMMARY OF THE INVENTION

The invention may be briefly explained as comprising a low profile turbine having a height substantially less than its diameter. The turbine may either include a dome-like solid side wall with close-louvered pockets, or a solid side wall attached to a hood in which the side wall is zig-zagged to provide wind-catching fins having a close-louvered construction. The turbine is affixed to a rotating shaft by means of an upper lock nut means and a slip fit bracket which supports the turbine by means of braces. The turbine is thereby removable from the rotary shaft. A mounting collar includes radial cross braces for the attachment of a thrust bearing located at the bottom of the rotary shaft and radial upper collar braces connected to a ball bearing assembly intermediate the upper lock nut means and thrust bearing. A fan blade assembly is affixed to the rotary shaft between the thrust bearing and ball bearing assemblies, whereby to be arranged within the mounting collar and turned by the rotary shaft resulting from the action of the closed louvers catching the wind.

The turbine side wall is arranged to vertically overlap the upper rim of the mounting collar and be spaced therefrom whereby to provide a large air passageway for the ventilation of hot air through the collar outwardly of the turbo fan vent, as well as a noiseless operation.

DETAILED DESCRIPTION OF THE INVENTION

Figure 1:
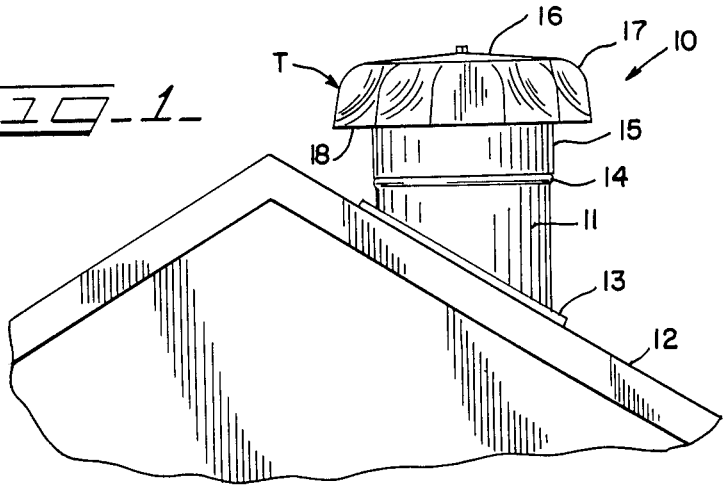
FIG. 1 is an elevational view of the roof of a building structure having mounted thereon the turbo fan vent in the preferred form of the invention.

With reference to the Figures, like reference numerals are used to refer to the same elements throughout.

FIG. 1 is an elevational view of the preferred form of the invention and comprises a turbo fan vent 10 mounted atop an adaptor stack 11 which is arranged to surround a hole in roof 12. Stack 11 is sealed therearound by a flashing material 13 in a known manner.

The roof 12 is sloped, and accordingly the bottom of adaptor stack 11 is cut at an appropriate angle to dispose the turbo fan vent 10 in the preferred vertical arrangement. The adaptor stack 11 includes a circumferential lip 14 generally near the top thereof whereby a mounting collar 15 of the turbo fan vent 10 is sleeve-fit thereover.

The turbo fan vent 10 further includes a low profile turbine T which has a radially sloped upper wall 16 formed with an integral side wall 17. Side wall 17 terminates at a circular lower edge 18.

Figure 2:
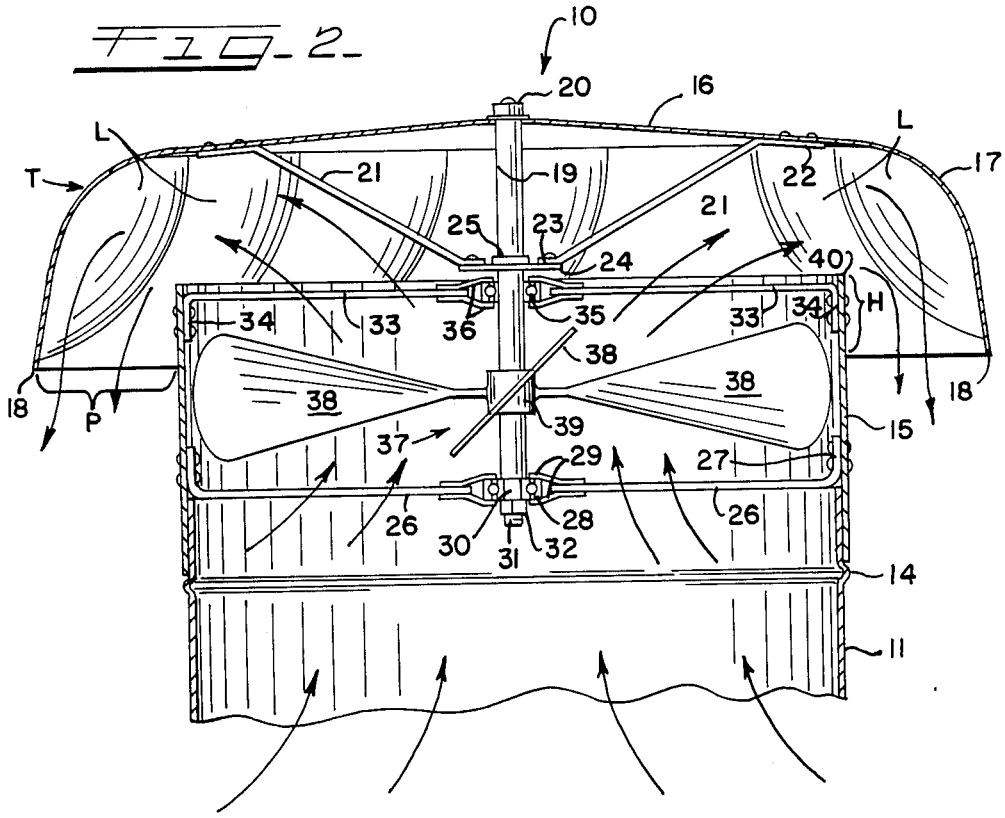
FIG. 2 is a vertical sectional view of the turbo fan vent shown in FIG. 1 taken generally through the central vertical axis of the rotary shaft.

With reference now made to FIG. 2, it will be seen that side wall 17 is provided with a plurality of closed louvers L which are pocket-shaped enabling the wind to impact thereon and thereby turn the turbine T.

The turbine T is affixed to a central rotary shaft 19 by means of a lock nut 20 engaged to the shaft 19 through a central opening in the upper wall 16. Dome braces 21 extend downwardly from the interior side of upper wall 16 and are affixed at bent portions 22 by conventional fasteners. The dome braces 21 preferably comprise four generally radial members that terminate at their lower ends in horizontally bent portions 23 which are affixed to a circular bracket 24 by conventional fasteners, such as rivets. The bracket 24 provides a slip fit opening 25 so that by unlocking the lock nut 20, turbine T may be moved upwardly to disengage bracket 24 from shaft 19 granting access to the interior of collar 15.

The collar 15 is adapted to slide over the adaptor stack 11 to dispose a lower edge thereof at the circumferential lip, or stop, 14. Arranged generally near the bottom of collar 15 are radial cross braces 26 which have upwardly bent outward ends 27 fastened to the collar 15. At opposite free ends of the cross braces 26 a thrust bearing assembly 28 is arranged around the shaft and supported by yoke-shaped connectors 29 which are outwardly affixed to the cross braces 26. Preferably, three cross braces 26 support the thrust bearing assembly 28. The thrust bearing assembly 28 associates with a smaller diameter shank portion 30 of rotary shaft 19, as would be understood by one skilled in art. The lower end of shank 30 is threaded at 31, whereby to be engaged by a lock nut 32 to thereby vertically constrain the rotary shaft 19 upon receiving upward thrust forces as the turbine T spins.

Arranged generally near the top portions of collar 15, three collar braces 33 radiate inwardly toward shaft 19 and are affixed to the collar 15 by means of downwardly bent portions 34. The cross collar braces 33 support a ball bearing assembly 35 by means of yoke-shaped connectors 36 in substantially the same construction as with the connectors 24 used for braces 26.

It will be understood that the turbine T and shaft 19 freely spin together by means of thrust bearing assembly 28 and ball bearing assembly 35.

The construction advantageously allows for the provision of a large fan blade assembly 37 to be affixed on rotary shaft 19 and dispose a plurality of fan blades 38 between the cross braces 26 and collar braces 33. In the preferred embodiment, fan blade assembly 37 comprises four blades 38 which are centrally affixed to the shaft 19 by means of a tightly fitting hub 39. The diameter of fan blade assembly 37 is preferably only slightly less than the diameter of collar 15, so that a strong upward ventilating draft is created as turbine T rotates shaft 19. In the exemplary embodiment, the diameter of fan blade assembly 37 is about one-eighth ($\frac{1}{8}$) inch less than the diameter of collar 15.

The invention is in large part characterized by the spacing or passageway P provided between the side wall 17 and the collar 15 in order to create a doughnut-like, or ringed, spacing therebetween. Thus, when winds diminish, or in the event of a bearing freeze, a large cross-sectional ventilating area is provided by passageway P, as shown by the arrows. The spacing, or passageway P, further provides a relatively noiseless arrangement in that the spinning turbine T is spaced far away from the collar 15 and vibration or contact therebetween is eliminated. Additionally, the turbo fan vent 10 is further characterized by an overlap height H, denoting the vertical dimension between an upper rim 40 of collar 15 and the bottom edge 18 of side wall 17. This overlap height H allows for the positioning of edge 18 well below rim 40 so that upon experiencing violent wind conditions during rainstorms and the like, rainwater is efficiently blocked from intruding inwardly of collar 15.

As a result, the combination of the closed louvers L, the low profile turbine T, the overlapping dimension H and large passageway P, provide for a weather-resistant, silent and efficient construction for turbo fan vent 10 in solution of the problems with prior art devices.

Figure 3:
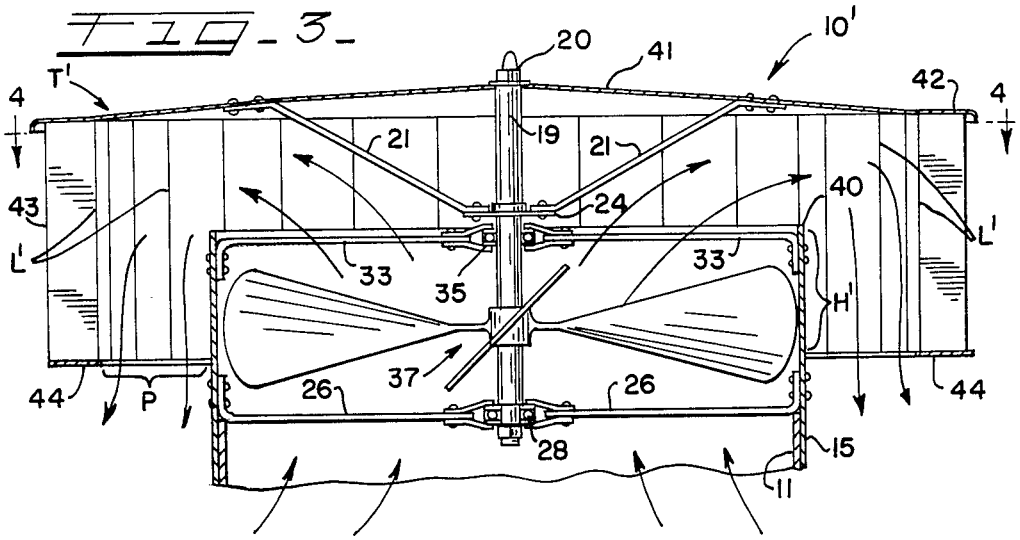
FIG. 3 is a vertical section substantially the same as that in FIG. 2 and having an alternate embodiment for the close-louvered turbine mounted on the rotating shaft.

FIG. 3 provides for an alternate preferred embodiment in the form of turbo fan vent 10' which only differs from turbo fan vent 10 in that a changed configuration for the turbine is shown at T'. The identical components 19–40 similarly reside within turbo fan vent 10' as would be understood.

Figure 4:
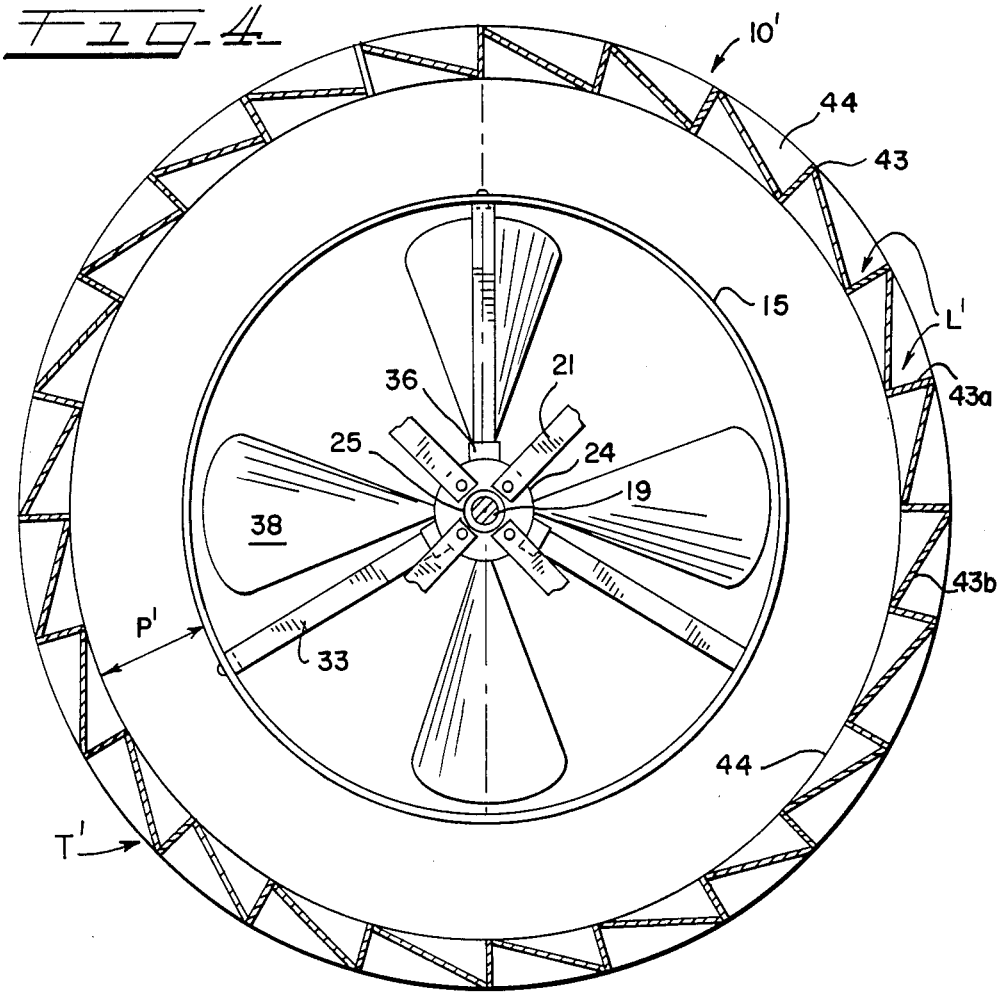
FIG. 4 is horizontal section of the embodiment of the turbo fan vent shown in FIG. 3 taken generally along line 4—4 thereof, and showing the spaced relationship of the close-louvered turbine and concentric mounting collar having the fan assembly arranged therein on the rotary shaft.

Turbine T' includes a radially sloped upper wall 41 that terminates in a circumferential flat edge portion 42. A close-louvered construction is again attained by the provision of a solid side wall 43, which is zig-zagged in section as best shown in FIG. 4. In the preferred embodiment, opposite the upper wall portion 42, a ring-shaped lower bottom wall 44 is affixed to the lower edge of wall 43 whereby the fin-type closed louvers L' are secured therebetween. The closed louvers L' forming wall 43 may be fastened to the upper wall portion 42 and bottom ring wall 44 by, for example, welding or riveting.

The wall 43 consists of radial wall portions **43*a*, each having the outward edge thereof connected by a diagonal wall portion 43*b* to the inward edge of the next clockwise adjacent radial wall portion 43*a*. This arrangement forms the closed fins, or louvers L', which are capable of catching wind currents in similar fashion to the closed louvers L of the turbine T. The dimensions of walls 43*a* and 43*b*** may be varied depending upon climatic conditions and average wind velocities as might be needed.

In similar fashion to turbo fan vent 10, a spacing is created between the ring-shaped wall 44 of the turbine T' and collar 15, to create a large passageway P' for the ventilation of the air from the structure below as shown by the arrows. Also, a vertical overlap, or height, H' is provided between the upper rim 40 of collar 15 and ring wall 44 which enhances the weather resistant characteristics as explained. The spacing or passageway P' between the turbine T' and collar 15, similarly allows for the noiseless rotation of the turbine T' around the collar 15 by eliminating the opportunity for vibration therebetween during rotation.

As would be understood by those skilled in the art, the louvered side wall 17 of turbine T and the side wall 43 of turbine T' may be varied to have larger or smaller heights in order to satisfy the ventilation capacity needs for different average wind conditions in various climates.

Both the preferred embodiment T and alternate embodiment T' provide for a very low profile that is relatively inconspicuous when installed on a roof and which feature is particularly desirable in residential construction where unsightly large prior art turbines have heretofore been used.

The large ventilating passageways P and P' provide a horizontal spacing between the collar 15 and either of the side walls 18 or 43. P and P' preferably have a width equal to no less than one-third of the radius of the collar 15. In the Figures, the diameter of collar 15 is twelve inches and the outer diameter of the turbines T and T' are seventeen inches thereby providing spacings P aand P' of about two and one half inches measured between the turbine side walls and collar 15.

The protective overlap H shown with respect to turbo fan vent 10 is preferably about one to two inches, but may be increased in order to provide for a greater protection from the weather, particularly suitable in high rainfall and stormy areas.

The construction of the turbo fan vent 10' utilizing turbine T' is envisioned as providing for a greater overlap whereby the height H' is preferably from about two to three inches. This greater overlap is more easily achieved with turbine T' since the construction of the side wall 43 includes the upper wall portion 43 and bottom ring wall 44 that offer greater wall stiffness than with turbine T since with turbine T the lower edge 18 is substantially a free skirt edge rendering side wall 17 susceptible to a larger amount of dynamic deflection than, for example, a side wall 43 of equal height.

It is envisioned that bottom ring wall 44 may be eliminated, whereby the fin-shaped side wall 43 would terminate in a free zig-zagged lower edge, similar to the provision of the free, but generally circular, lower edge 18 of the turbine T.

It will be understood that numerous configurations and embodiments utilizing the inventive concepts set forth above will be found by those skilled in the art. Therefore, the claims are not to be considered as being limited to the embodiments disclosed, but rather to include a large range of equivalents.

What is claimed is:

1. A turbo fan vent capable of being rotated by wind currents comprising:

a turbine having a solid upper wall and side wall, said side wall having a plurality of closed louvers therearound, said side wall having a height substantially less than its diameter;

a rotary shaft removably fastened at a top end thereof to the upper wall of the turbine by releasable lock means associating thereat;

a plurality of braces extending from connections to the upper wall of the turbine and terminating at a bracket means, the bracket means being arranged along the rotary shaft below said releasable lock means and having an opening therethrough slidably receiving said rotary shaft therein, whereby upon unlocking said releasable lock means, the turbine, braces and bracket means are slidably removable from the rotary shaft;

collar means vertically overlapping a portion of said side wall and having a diameter substantially less than said turbine side wall, said collar means supporting interiorly thereof upper and lower bearing means supportably and rotatably holding said rotary shaft;

said upper bearing means journalling said rotary shaft below said bracket means and being supported by a plurality of radial collar braces extending from connections to the collar means;

said lower bearing means being a thrust-type bearing assembly arranged generally at the lower end of the rotary shaft, and being supported by a plurality of radial cross braces extending from connections to the collar means;

a fan assembly having a plurality of fan blades arranged within said collar and said fan blades each being centrally affixed to hub means secured to said rotary shaft at a location therealong between said upper and lower bearing means, whereby upon the rotation of said turbine, said fan assembly spins in response thereto whereby to create an upward ventilating draft towards said turbine and outwardly therefrom in a passageway defined between said turbine side wall and collar.

2. A turbo fan vent as claimed in claim 1 wherein said side wall is formed integrally with the upper wall and the closed louvers are pocket-shaped.

3. A turbo fan vent a claimed in claim 1 wherein said side wall is zig-zag-shaped in section to form circumferentially therearound a plurality of generally fin-shaped closed louvers, said side wall being rigidly affixed to the upper wall along an upper edge of the side wall.

4. A turbo fan vent as claimed in claim 3 wherein a bottom wall means is affixed along a lower edge of said side wall.

5. A turbo fan vent as claimed in claim 1 wherein the fan assembly has a diameter slightly less than the diameter of the collar.

6. A turbo fan vent as claimed in claim 1 wherein the upper bearing means comprises a ball bearing assembly.

7. A turbo fan vent as claimed in claim 6 wherein the thrust-type bearing assembly contacts said rotary shaft at a reduced diameter shank portion thereof, said shank portion having a lower threaded end, said lower threaded end being engaged by a lock nut means whereby to vertically constrain said rotary shaft from upward displacement.

8. A turbo fan vent as claimed in claim 1 wherein the passageway defined between the side wall of the turbine and the collar has a width no less than one-third of the radius of the collar.

9. A turbo fan vent as claimed in claim 1 wherein the air flow path from a dwelling, or the like, below, through the vent is through substantially the full cross section of the collar means and past the upwardly air driving fan assembly to exit the collar means to be directed toward the full underside of the upper wall of the turbine and lastly to be forced outwardly on the turbo fan vent through the passageway defined between the side wall of the turbine and the collar means.

10. A turbo fan vent as claimed in claim 1 wherein the length of the rotary shaft is substantially less than the diameter of the turbine whereby the turbine and collar means combine to give the turbo fan vent a very low flattened profile.

11. A turbo fan vent as claimed in claim 1 wherein the vertical overlap height between said collar means and turbine side wall may be varied by changing the height of the side wall.

12. A turbo fan vent as claimed in claim 1 wherein the vertical overlap between the turbine side wall and collar means is from about one inch to about three inches.

* * * * *